US007316042B2

(12) United States Patent
Marcora et al.

(10) Patent No.: US 7,316,042 B2
(45) Date of Patent: Jan. 8, 2008

(54) MACHINE AND METHOD FOR THE CONTINUOUS TREATMENT OF A FABRIC

(75) Inventors: Luigi Marcora, Florence (IT); Alberto Ciabattini, Prato (IT)

(73) Assignee: Coramtex S.R.L., Prato (IT)

( * ) Notice: Subject to any disclaimer, the term of this patent is extended or adjusted under 35 U.S.C. 154(b) by 648 days.

(21) Appl. No.: 10/489,458

(22) PCT Filed: Sep. 9, 2002

(86) PCT No.: PCT/IT02/00575

§ 371 (c)(1),
(2), (4) Date: Sep. 14, 2004

(87) PCT Pub. No.: WO03/023111

PCT Pub. Date: Mar. 20, 2003

(65) Prior Publication Data

US 2005/0066694 A1 Mar. 31, 2005

(30) Foreign Application Priority Data

Sep. 12, 2001 (IT) ..... FI2001A0168

(51) Int. Cl.
*D06B 5/02* (2006.01)

(52) U.S. Cl. ..... 8/151; 8/152; 68/178; 68/179; 68/180

(58) Field of Classification Search ..... 8/151, 8/152; 68/177, 178, 179, 180
See application file for complete search history.

(56) References Cited

U.S. PATENT DOCUMENTS 2,136,571 A * 11/1938 Wedler ..... 8/151
3,213,470 A * 10/1965 Yasawa et al. ..... 8/149.3
3,247,660 A * 4/1966 Reeder et al. ..... 57/32
4,392,365 A * 7/1983 Miyamoto et al. ..... 68/19
4,679,333 A * 7/1987 Vinas ..... 34/629
4,866,956 A * 9/1989 Ciprandi ..... 68/22 R
4,939,914 A * 7/1990 Driesen et al. ..... 68/22 R
4,974,341 A * 12/1990 Vinas ..... 34/640
5,014,525 A * 5/1991 Bene ..... 68/20
5,243,840 A * 9/1993 Grafen et al. ..... 68/62
5,309,613 A * 5/1994 Strahm ..... 26/27
5,349,711 A * 9/1994 Iwami ..... 8/152
5,431,031 A * 7/1995 Vinas ..... 68/5 D
5,623,738 A * 4/1997 Biancalani et al. ..... 8/152
5,845,355 A * 12/1998 Strahm ..... 8/152
6,425,271 B1 * 7/2002 Vinas ..... 68/177

FOREIGN PATENT DOCUMENTS

| | | | |
|---|---|---|---|
| EP | 0 341 183 | | 11/1989 |
| EP | 0 535 287 | | 4/1993 |
| FR | 2 619 834 | * | 3/1989 |
| GB | 2 158 472 | | 11/1985 |

* cited by examiner

*Primary Examiner*—Frankie L. Stinson
(74) *Attorney, Agent, or Firm*—McGlew and Tuttle, P.C.

(57) ABSTRACT

The machine comprises in combination: means (7) for supplying the fabric (T); means (9) for extracting the fabric; at least one first tank (1) and one second tank (3) which are positioned in series and between which a pneumatic transfer member (5) for transferring the fabric alternately from the first tank to the second tank and vice versa is arranged. The pneumatic transfer member is pivotable so as to assume at least two positions depending on the direction of feeding of the fabric through said pivoting transfer member.

13 Claims, 2 Drawing Sheets

MACHINE AND METHOD FOR THE CONTINUOUS TREATMENT OF A FABRIC

DESCRIPTION

1. Technical Field

The present invention relates to a machine for the continuous treatment of a fabric. More particularly, the invention relates to a machine for the continuous treatment of a fabric both in open width form and preferably in rope form, with or without immersion in a bath.

The invention also relates to a method for the continuous treatment of a fabric.

2. State of the Art

In the field of the processing and finishing of fabrics, machines which perform the treatment of lengths of fabric both with and without immersion in a bath are known, said machines conveying the fabric along a path where the fabric itself undergoes the mechanical action of one or more mechanical members and, if necessary, a chemical action by means of enzymes and/or a thermal action.

This type of machine normally operates in a discontinuous cycle. This means that a section of fabric of finite length is introduced into the machine and closed, joining together the leading end and tail end of the section and forming a kind of ring. This ring of fabric is made to circulate a sufficient number of times, i.e. for a sufficient treatment period, along the treatment path. Once treatment has finished, the machine is stopped, if necessary depressurized, opened and the treated fabric is extracted from it and replaced with a new fabric to be treated.

This type of machine has the drawback that the machine must be frequently stopped for loading and unloading. This results in lost production time and high labor costs. The need to depressurize and cool the machine (when it is working under pressure and/or at temperature) also results in a notable expenditure of energy.

Machines which perform this type of processing operation in a continuous cycle have therefore been developed. In these machines the fabric is introduced at one end of the machine, passes through the machine along a treatment path and is extracted gradually from the machine at the opposite end of the path. Inside the machine a supply of fabric is formed, this supply moving at a faster speed than the speed of insertion and extraction of the fabric into/from the machine, such that each section of fabric undergoes more than one treatment along the path inside the machine.

GB-A-2,158,472 describes a machine of this type, for the continuous treatment of a fabric in open width form. In this machine, the fabric is gradually introduced inside a first chamber and gradually extracted from a second chamber. The two chambers are joined together by a pneumatic path which has the form of an overturned "U" and along which the open fabric is conveyed first in one direction and then in another direction by means of air jets. The mechanical processing operations which may be performed on the fabric with this machine are somewhat limited in effect. Moreover, conveying of the fabric is difficult owing to the winding nature of the path and the limited efficiency of the air jets which act on the fabric during treatment.

EP-A-0,341,183 describes another machine for the treatment of a fabric again in open width form and continuously. In this case, inside the machine, the fabric is transferred alternately from one section to another using a pneumatic system and is made to strike against mechanical treatment members arranged facing the outlets of a pneumatic conveying duct. In this case also, the efficiency of the treatment is limited.

OBJECTS AND SUMMARY OF THE INVENTION

The object of the invention is to provide a machine for the continuous treatment of a fabric, of the type comprising at least two tanks arranged in series and a pneumatic transfer member for transferring alternately the fabric between the tanks, which machine has a greater efficiency than the machines known hitherto.

These and further objects and advantages, which will become clear to persons skilled in the art from reading of the text which follows, are obtained essentially with a machine of the abovementioned type in which:

- the pneumatic transfer member is pivotable so as to assume at least two positions depending on the direction of feeding of the fabric through said pivoting transfer member;
- in front of the transfer member, opposite the first and second tanks, two respective grille structures are arranged, the fabric being made to strike against said structures as a result of the kinetic energy imparted to it by the transfer member;
- and in which, on the opposite side of each grille structure, with respect to the transfer member, a respective suction mouth is arranged, said mouth sucking in the conveying air emerging from the transfer member.

The pivoting movement of the transfer member, which may in practice be a double Venturi tube, facilitates extraction of the fabric from the pick-up tank and its expulsion on the opposite side. The suction of air performed on the opposite side of each grille to the side from where the fabric is "fired out" by the transfer member, increases the air flow which conveys the fabric and causes it to strike the grille. This increases the treatment efficiency of the machine. A greater treatment efficiency also allows a reduction in the number of passes which each section of fabric must undergo inside the machine, with a consequent increase in the productivity of the machine itself. As a result of the sucked-in air flow, it is possible to achieve a high acceleration of the fabric upon every reversal in the direction of feeding and therefore achieve the necessary speed for obtaining effective treatment even when the supply of fabric present inside the machine is relatively small.

"Grille structure" is understood as meaning any structure suitable for forming an impact surface for the fabric and at the same time able to allow the air to pass through. It may be formed by a series of horizontal and/or vertical bars, a perforated metal sheet, a continuous metal sheet with a central slit or a series of slits varyingly arranged, or other system.

Further advantageous features of the machine according to the invention are defined in the accompanying dependent claims.

It must be noted that the machine may be designed for treatment of the fabric in open width form. In this case the transfer member will be in the form of a duct with a narrow and elongated cross-section. Similarly the grilles against which the fabric strikes will be sufficiently wide to receive the entire width of the fabric.

Preferably, however, the machine is designed for the treatment of fabric in rope form. In this case the transfer member will be in the form of a conveying duct with a smaller cross-section, and in particular with a smaller difference between the length and the width of the cross-section. Preferably, the duct will have a rectangular shape.

The treatment of fabric in rope form produces results which are better in terms of effectiveness of the treatment, since greater mechanical processing of the fibers is achieved, with a consequent breakage of the said fibers and softening of the fabric.

The machine may be used for processing operations involving drying, steaming and treatment, in specific and other kinds of baths, of continuous lengths of fabric.

The machine may also perform the treatment of a dry or moist fabric. In a particular embodiment, it is also possible to envisage that the tanks have inside them a bath, for example containing suitable enzymes or other chemical products intended to have on the fabric an effect combined with the mechanical action which the fabric undergoes during transfer inside the transfer member and striking against the grilles.

The object of the invention is also to provide a method for the continuous treatment of a fabric, which is particularly efficient.

Substantially according to the invention, the method for treatment of the fabric comprises the steps of:

gradually introducing the fabric into a first tank of a treatment machine;

gradually extracting the fabric from a second tank, forming a supply of fabric which is transferred pneumatically from the first tank to the second tank and vice versa, undergoing a mechanical treatment;

pneumatically propelling the fabric alternately against a first or against a second grille structure associated with the first and the second tank respectively, generating an output air current acting against a first side of the respective grille structure and an intake air current on the opposite side of said grille.

It must be understood that the machine may also have more than two tanks which are arranged in series and which may be aligned or also situated alongside each other, with a suitable system for deviating the path of the fabric.

BRIEF DESCRIPTION OF THE DRAWINGS

The invention will be better understood with reference to the description and the accompanying drawing which illustrates a practical embodiment of the invention. More particularly, in the drawing.

DETAILED DESCRIPTION OF AN EMBODIMENT OF THE INVENTION

Figure 1:
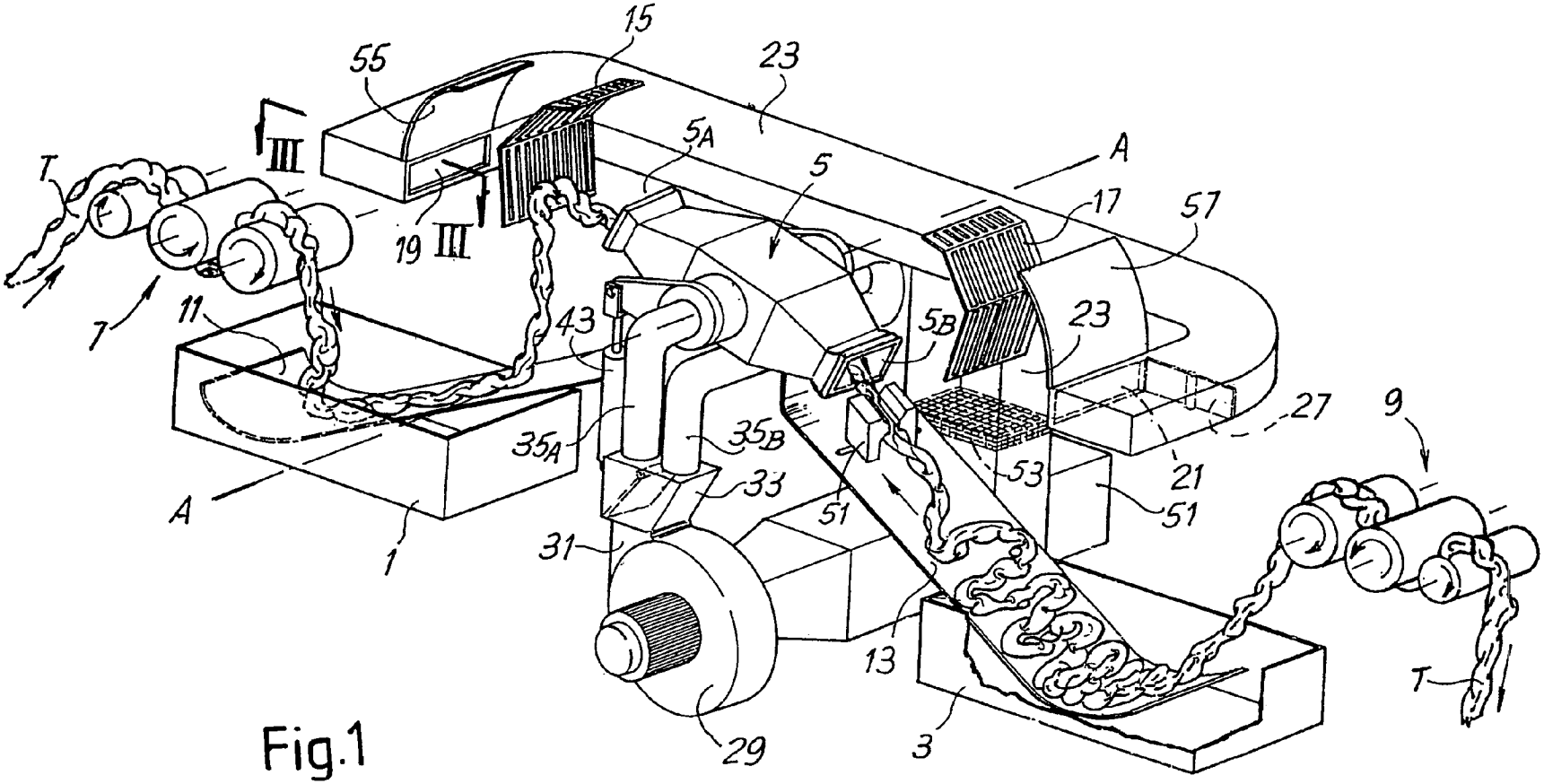
FIG. 1 shows a perspective view of the internal part of the machine as a whole, from which the walls and the external housing have been removed in order to show the internal components.

FIG. 1 shows the internal components of the machine in a perspective view, all the external containing walls and housing having been removed so as to provide an overall view of the inside of the machine itself.

In the example illustrated, the machine is designed for the treatment of fabric in rope form, as mentioned above, but may also be designed for the treatment of fabric in open width form.

The machine has inside it a first tank 1 and a second tank 3 which are positioned in series along a path for treatment of the fabric T and between which a transfer member denoted overall by 5 is arranged. The tank 1 has, associated with it, a conveying unit 7 for introduction of the fabric T, while the tank 3 has, associated with it, a second conveying unit 9 for extraction of the treated fabric from the machine. The two conveying units 7 and 9 have a plurality of cylinders, at least one of which is motorized so as to impart to the fabric T the necessary speed for insertion and extraction from the machine in such a way as to obtain a continuous gradual insertion and continuous gradual extraction of the fabric into and from the machine in the direction indicated by the arrows.

Inside the machine, the fabric T forms a supply which is distributed between the tanks 1 and 3. In the condition shown in FIG. 1, the supply of fabric T is situated practically all inside the tank 3 and the transfer member 5 is positioned so as to remove the supply of fabric from the tank 3 and transfer it into the tank 1 in the manner which will be described below. The speed of transfer of the supply from one tank to another is preferably much greater than the speed of insertion and extraction of the fabric into/from the machine, such that each section of fabric undergoes inside the machine, before emerging from it, a plurality of treatment passes, being transferred several times from one tank to the other.

Slides 11 and 13 on which the fabric T rests are respectively arranged inside the tanks 1 and 3. The slides 11 and 13 are shaped, in their bottom part, so as to form a sort of cradle and extend upward and toward the transfer member 5, forming guide surfaces for the fabric T. The slides 11 and 13 are made of or lined with a material having a low coefficient of friction, for example Teflon®, in order to facilitate sliding of the fabric.

The transfer member 5 pivots about an axis A-A which is horizontal and perpendicular to the direction of feeding of the fabric through the machine. The transfer member 5 is symmetrical with respect to the axis A-A and has two opposite mouths 5A and 5B (see in particular FIG. 2 also).

Two grille structures 15 and 17 are provided in positions facing each other, opposite the transfer member 5, so as to be located respectively opposite the mouth 5A and the mouth 5B. As can be seen in FIG. 1, when the transfer member 5 is located in the position shown there, the mouth 5A is located exactly facing the grille structure 15, while the mouth 5B is located directed downward and pointing toward the slide 13, i.e. the bottom of the tank 3. By pivoting the transfer member 5 so as to bring it into a position which is symmetrical with respect to that shown in FIG. 1, relative to the horizontal plane containing the axis A-A, the mouth 5A will be located pointing downward, i.e. toward the bottom of the tank 1, while the mouth 5B will be located facing the grille structure 17.

Figure 3:
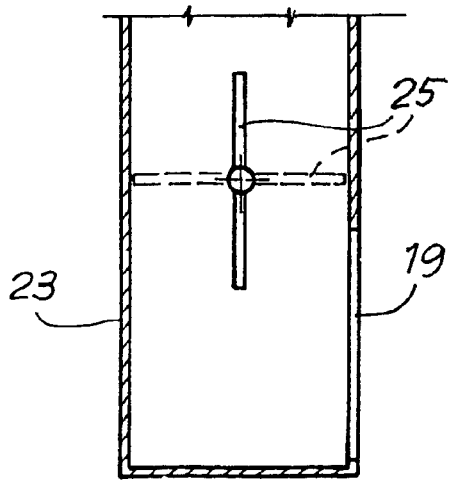
FIG. 3 shows a detail of one of the ends of the suction ducts in which the suction mouths are formed.

Respective suction mouths 19 and 21, which are formed at the ends of a U-shaped duct denoted by 23 and lying in a substantially horizontal plane are located behind the grille structures 15 and 17. Respective opening and closing gates indicated by 25 and 27 are located inside the duct 23, in the vicinity of the suction openings 19 and 21 (see in particular also the detail in FIG. 3).

In the condition shown in FIG. 1, the gate 25 associated with the suction mouth 19 is located in an open position, while the gate 27 associated with the suction mouth 21 is located in the closed position.

The suction duct 23 is connected to the intake of a fan 29, the output 31 of which is connected, via a gate 33, to the pneumatic transfer member 5. By means of the gate 33, the air flow from the output 31 may be deviated into one or other of the two ducts 35A and 35B which are connected by means of respective headers 37A, 37B (FIG. 2) to the transfer member 5.

Figure 2:
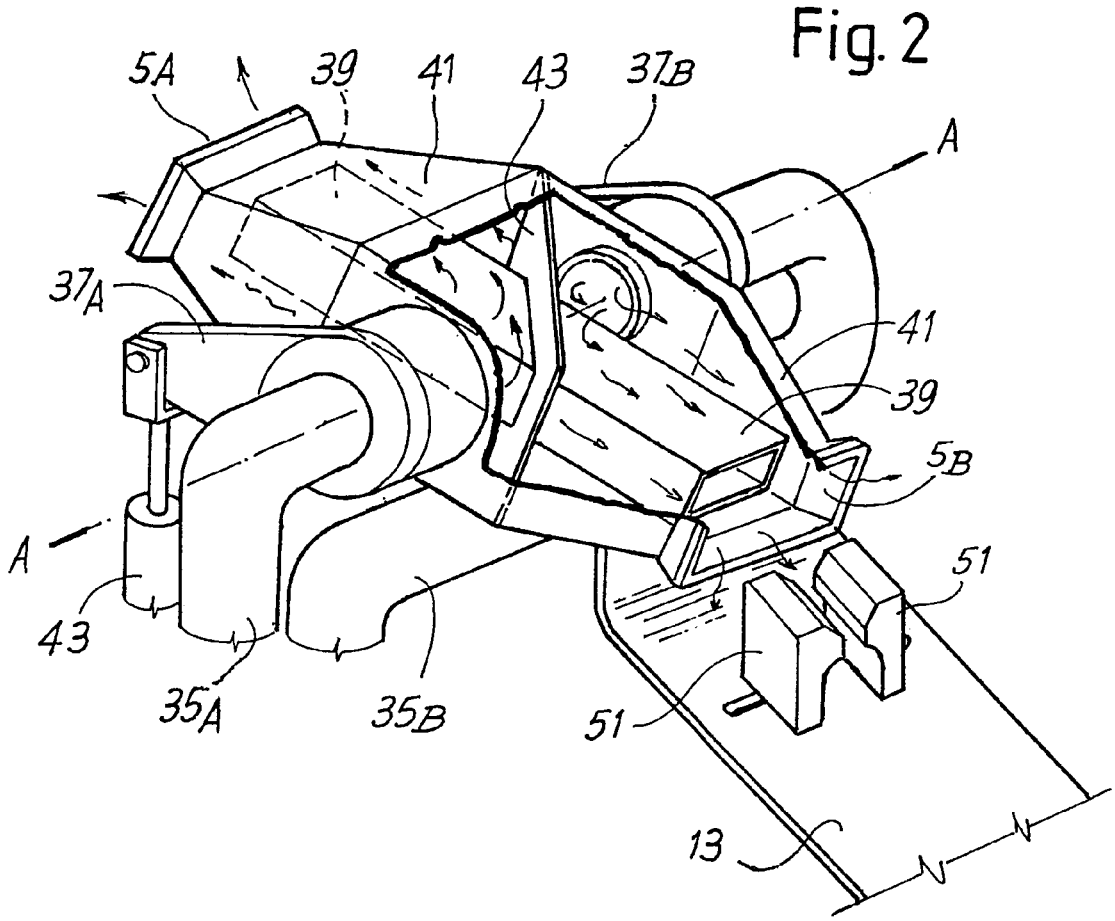
FIG. 2 shows a perspective and partially sectioned view of a detail of the double Venturi tube.

As can be seen in particular in FIG. 2, the transfer member 5 has an external casing defining the mouths 5A and 5B inside which a rectangular through-duct 39 is located. A space divided by means of inclined walls 43 into two parts is defined between the external casing, indicated by 41 in FIG. 2, and the internal through-duct 39. One part of this space is connected to the mouth 5A and to the duct 35A, while the other part is connected to the mouth 5B and to the duct 35B.

With this arrangement depending on the position of the gate 33, air is introduced at high speed into one or other of the two parts into which the space or cavity defined between the casing 41 and the rectangular duct 39 is divided, and therefore an air flow emerging from the mouth 5A or 5B, respectively, is produced. The air flow draws along the fabric introduced into the rectangular duct 39.

The pivoting of the transfer member 5 about the axis A-A is controlled by means of an actuator 43, for example a cylinder/piston actuator (FIG. 1).

The machine described hitherto functions as follows.

The fabric T is gradually introduced into the first tank 1 by means of an inward conveying unit 7 and gradually extracted from the tank 3 by means of an outward conveying unit 9. The supply of fabric which is formed in the two tanks is transferred alternately from one tank to the other by means of the transfer member 5. In the condition shown in FIG. 1, the supply of fabric present in the tank 3 is gradually extracted from it and transferred in the tank 1. This operation is performed by the transfer member 5 which, during this step, is inclined with respect to the horizontal so that its mouth 5A is directed upward against the grille structure 15, while the mouth 5B is directed downward and pointing toward the slide 13 and the bottom of the tank 3. The mouth 5B therefore forms an inlet opening for the fabric, while the mouth 5A forms the outlet opening for the fabric and is located substantially aligned with the suction mouth 19.

This position facilitates picking up of the fabric from the tank 3 and its propulsion against the grille structure 15 as a result of the air flow generated in the cavity between the casing 41 and the rectangular duct 39 inside the transfer member 5. The gate 33 is located in a position such as to introduce all the air supplied from the fan 29 into the duct 35A. The gate 25 inside the suction duct 23 is open, while the gate 27 is closed. This has the effect that an air flow is sucked in through the suction mouth 19 and is added to the air flow emitted by the transfer member 5, thereby increasing the force with which the fabric is made to strike against the grille structure 15. Basically, the air emerging from the transfer member 5 or at least a part thereof is sucked in by the rear-lying suction mouth 19.

The air sucked in through the suction mouth 19 and the duct 23 is drawn off by the fan 29 and introduced again into the transfer member 5.

Thus, on the one hand a greater efficiency in the mechanical treatment of the fabric and on the other hand a greater thermal efficiency is obtained since the air used for the pneumatic transfer follows a closed path inside the machine. If the air has been conditioned, for example heated and/or humidified, this avoids dissipation of the energy used for conditioning purposes.

When the fabric supply inside the tank 3 has been used up, the position of the conveying member 5 is switched by means of pivoting in an anti-clockwise direction and the position of the gates 25, 27 and 33 is also switched. The output air flow from the fan 29 is then introduced through the duct 35B into the part of the cavity between the casing 41 and the tube 39 which communicates with the mouth 5B. The fabric is in this way removed by means of the transfer member 5 from the slide 11 and then from the tank 1 and propelled against the grille structure 17.

The machine may be suitably completed with a burner 51, for example of the gas type, for generating the heat necessary for keeping the air circulating inside the machine heated. The air is heated by means of a heat exchanger as it passes from the suction duct 23 to the fan 2.

Extractable filters 53 for removing any loose pile released by the fabric are also provided inside the suction duct 23.

Deflectors 55, 57 for directing and containing the air flow are also provided above the ends of the suction duct 23 opposite the grille structures 15 and 17.

The machine may be suitably equipped with ducts for releasing the used air and introducing fresh air so as to perform gradual and controlled renewal of the internal air and therefore control the moisture and temperature conditions in an efficient manner.

In the example shown, the machine is equipped with two pairs of shaped brackets which are arranged in front of the mouths 5A and 5B of the transfer member 5, along the respective slides 11, 13. One of said pairs of brackets can be seen in particular in FIG. 2 and is denoted by 51. These brackets define a passage with a narrow cross-section for the fabric, such that on the entry side of the transfer member 5, the fabric is forced to pass between the brackets before entering into the transfer member 5 itself. On the exit side of the transfer member, the fabric passes over the brackets 51 which, on this side, do not have any effect. It may also be envisaged to splay the brackets on the fabric exit side so as to prevent them from hindering the passing movement of the fabric itself. The mutual distance of the brackets may be modified depending on the width and the thickness of the fabric and/or depending on the degree of mechanical treatment which they must perform on the fabric.

The effect of the shaped brackets 51 is similar to that of the fabric constriction ring provided along the closed treatment path in machines which operate in a discontinuous cycle: the fabric removed from the tank in which the supply is present undergoes lateral compression by the brackets 51, while it is pulled by the transfer member 5. The lateral compression has the mechanical effect of breaking the fibers, in addition to the effect due to propulsion against the grille structures 15, 17.

It is understood that the drawing shows only an example provided by way of practical demonstration of the invention, it being possible to vary the forms and arrangements of the invention without thereby departing from the scope of the idea underlying the invention itself. The presence of any reference numbers in the accompanying, claims is intended to facilitate reading of the claims with reference to the description and the drawing and does not limit the scope of protection defined by the claims.

The invention claimed is:

1. A machine for continuous treatment of a fabric, comprising:

means for supplying the fabric;

means for extracting the fabric;

between the supplying means and the extraction means, a section for treatment of the fabric with at least one first tank and one second tank which are positioned in series and between which a pneumatic transfer member for transferring the fabric alternately from the first tank to the second tank and vice versa is arranged;

characterized in that:

said pneumatic transfer member is pivotable so as to assume at least two positions depending on the direction of feeding of the fabric through said pivoting transfer member;

in front of said transfer member, opposite the first and second tanks, two grille structures are arranged, the fabric being made to strike against them by said transfer member;

on the opposite side of each grille structure, with respect to the transfer member, a respective suction mouth is arranged, said mouth sucking in the conveying air emerging from said transfer member.

2. Machine according to claim 1, characterized in that the two suction mouths are connected to a single intake duct and are equipped with intercepting members for intercepting the flow sucked in alternately through one or the other of said suction mouths.

3. Machine according to claim 2, characterized in that it is configured to treat the fabric in rope form.

4. Machine according to claim 1, characterized in that it is configured to treat the fabric in rope form.

5. Machine according to claim 1, characterized in that said transfer member comprises a pivoting double Venturi tube.

6. Machine according to claim 1, characterized in that each of said tanks has, arranged inside it, a respective slide for the fabric, above which the respective grille structure is situated, said transfer member being able to be oriented so as to have a fabric entry end directed toward the respective slide of the tank from which the fabric is removed and an exit end directed toward the grille structure of the tank into which the fabric is transferred.

7. Machine according to claim 6, characterized in that said exit end is substantially aligned with the corresponding suction mouth.

8. Machine according to claim 1, characterized in that a deflector for deviating the air supplied from said transfer member toward the respective suction mouth is arranged above and behind each of said grille structures.

9. Machine according to claim 1, characterized int hat it comprises, in front of the mouths of said transfer member, respective pairs of brackets between which the fabric is passed before entering into the transfer member, the mutual distance between the brackets of each pair being such as to cause lateral compression of the fabric.

10. Machine according to claim 9, characterized int hat the distance of the brackets of each pair is adjustable.

11. Machine according to claim 10, characterized in that said brackets may be moved toward or away from each other depending on the operating conditions of the machine.

12. Machine according to claim 9, characterized in that said brackets may be moved toward or away from each other depending on the operating conditions of the machine.

13. Method for continuous treatment of a fabric, comprising the steps of:

gradually introducing the fabric into a first tank;

gradually extracting the fabric from a second tank, forming a supply of fabric which is transferred pneumatically from said first tank to said second tank and vice versa, undergoing a mechanical treatment;

pneumatically propelling the fabric alternately against a first or against a second grille structure associated with said first and said second tank, generating an output air current acting against a first grille structure side and an intake air current on the second side of said grille.

* * * * *